US008127410B2

(12) United States Patent
Catallo

(10) Patent No.: US 8,127,410 B2
(45) Date of Patent: Mar. 6, 2012

(54) SPRING STEEL SLIP SHEET FOR A COMPACTOR AND FOR EXTENDING INTO A COMPRESSION ZONE DEFINED BY A FEED ROLL AND A RETARD ROLL FOR SHRINKING A FABRIC

(76) Inventor: Frank Catallo, Old Westbury, NY (US)

( * ) Notice: Subject to any disclaimer, the term of this patent is extended or adjusted under 35 U.S.C. 154(b) by 203 days.

(21) Appl. No.: 12/657,120

(22) Filed: Jan. 14, 2010

(65) Prior Publication Data

US 2010/0175234 A1 Jul. 15, 2010

Related U.S. Application Data

(60) Provisional application No. 61/205,110, filed on Jan. 14, 2009.

(51) Int. Cl.
*D06C 21/00* (2006.01)

(52) U.S. Cl. ..... 26/18.6

(58) Field of Classification Search ..... 26/18.6, 26/18.5, 21, 99; 162/111, 280, 281; 28/116, 28/134, 136, 138, 139, 165, 156
See application file for complete search history.

(56) References Cited

U.S. PATENT DOCUMENTS 3,260,778 A * 7/1966 Walton ..... 264/282
3,810,280 A * 5/1974 Walton et al. ..... 26/18.6
4,142,278 A * 3/1979 Walton et al. ..... 26/18.6
4,717,329 A * 1/1988 Packard et al. ..... 425/328
5,117,540 A * 6/1992 Walton et al. ..... 26/18.6
5,553,365 A 9/1996 Catallo
5,655,275 A 8/1997 Allison
5,666,703 A * 9/1997 Walton et al. ..... 26/18.6
5,666,704 A 9/1997 Price
5,669,155 A 9/1997 Hughes
5,678,288 A * 10/1997 Walton et al. ..... 26/18.6
5,724,689 A 3/1998 Milligan
5,794,317 A 8/1998 Allison
6,047,483 A 4/2000 Allison
6,681,461 B1 * 1/2004 Catallo ..... 26/18.6
7,854,046 B2 * 12/2010 Horn et al. ..... 26/18.6
2006/0053603 A1 * 3/2006 Catallo et al. ..... 26/18.6

* cited by examiner

*Primary Examiner* — Amy Vanatta
(74) *Attorney, Agent, or Firm* — Charles E. Baxley

(57) ABSTRACT

A spring steel slip sheet for a compactor and for extending into a compression zone defined by a feed roll and a retard roll for shrinking a fabric. The slip sheet is for the compactor, extends into the compression zone defined by the feed roll and the retard roll for shrinking the fabric, and is made of spring steel. The slip sheet is sheet-like and includes a mounting portion and a compressing portion. The compressing portion extends from the mounting portion at an interface line. The mounting portion usually is flat and the compressing portion usually is arcuate. The compressing portion curves similarly as the feed roll of the compactor does, and presses the fabric against the feed roll of the compactor as the fabric enters the compression zone of the compactor.

9 Claims, 2 Drawing Sheets

Figure 1:
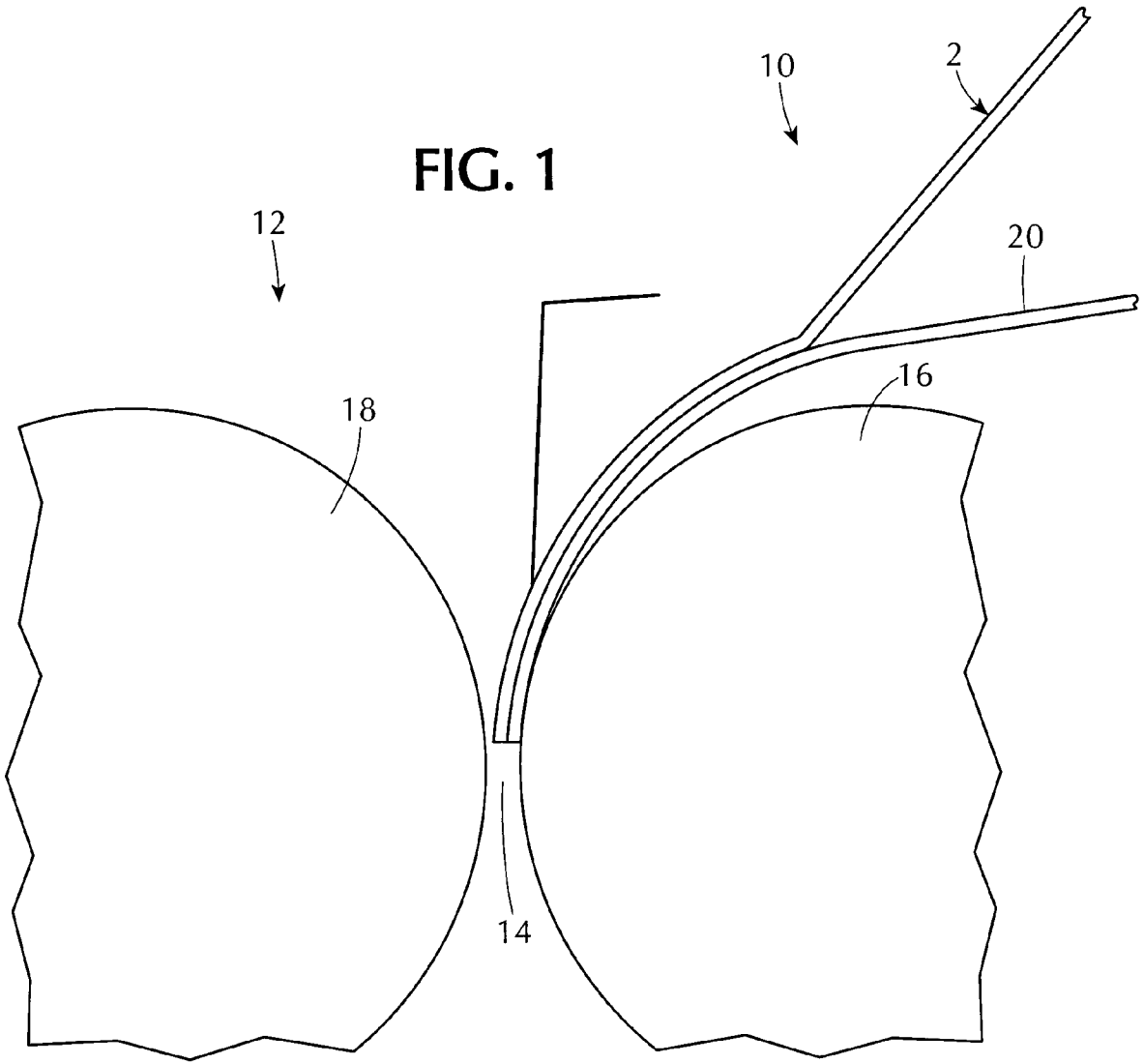

SPRING STEEL SLIP SHEET FOR A COMPACTOR AND FOR EXTENDING INTO A COMPRESSION ZONE DEFINED BY A FEED ROLL AND A RETARD ROLL FOR SHRINKING A FABRIC

1. CROSS-REFERENCE TO RELATED APPLICATIONS

The instant nonprovisional patent application claims priority from provisional patent application No. 61/205,110, filed Jan. 14, 2009, for a SPRING STEEL SLIP SHEET FOR A COMPACTOR AND FOR EXTENDING INTO A COMPRESSION ZONE DEFINED BY A FEED ROLL AND A RETARD ROLL FOR SHRINKING A FABRIC, and incorporated herein by reference thereto.

2. BACKGROUND OF THE INVENTION

A. Field of the Invention

The embodiments of the present invention relate to a slip sheet for a compactor, and more particularly, the embodiments of the present invention relate to a spring steel slip sheet for a compactor and for extending into a compression zone defined by a feed roll and a retard roll for shrinking a fabric.

B. Description of the Prior Art

The knitting industry uses for manufacture of garments various compacted knitted textile fabrics of different constructions generally accepted as having been shrink-proofed. For such compressive shrink-proofing, two-pass types of compactors have been in vogue, which compactors are typical of machines used for knitted fabric made of natural and/or man-made fibers. Although these compactors produce generally acceptable shrink-proofing results, they are temperamental and require frequent re-adjusting of their compression zones.

Compressive shrink-proofing of knitted textile fabrics formed from interlocked loops of yarns made usually of natural fibers or man-made fibers had its origin in shrink-proofing of woven textile fabric webs. With increased popularity of knitted garments, compressive shrink-proofing of knitted textile fabrics evolved from prior experience obtained by working with flat woven textile fabric webs. Woven textile fabric webs are rectilinear grids of threads having longitudinal warp threads interwoven by transverse fill threads. Emphasis in compaction for shrink-proofing of woven textile fabric webs naturally focused on a need for longitudinal compression. The woven textile fabrics were and are manufactured in such continuous webs that inevitably get stretched lengthwise while being woven, transported, and processed. So it was and is logical, convenient, and effective to shrink compressively the woven fabric webs in a longitudinal direction along their continuous webs. Knitted textile fabrics, like randomly deposited fabrics made of natural or man-made fibers, however, are neither formed nor structured similarly to woven textile fabrics.

Knitted textile fabrics, for example, are composed of yarns, usually of natural fibers, formed in interlocking curvilinear loops arranged in stitch rows sometimes aligned perpendicularly to, and sometimes skewed from perpendicular orientations relative to, alignment of their continuous webs. The loops generally interlock with each other substantially at right angles (orthogonally) to their respective stitch rows. It is sometimes convenient to visualize stitch rows ideally as being straight and aligned transversely relative to a longitudinal path of the fabric like soldiers marching on parade through their compactor. Yet such an ideal image of stitch rows through a compactor rarely finds its counterpart in the real world. Knitted textile fabrics frequently are not designed with straight transverse stitch rows. Handling and treatment of knitted textile fabrics, warp, bend, twist, and otherwise distort their stitch rows. Further, the stitch rows themselves are formed as a progression of repeating series of curvilinear loops of yarn. So as far as compacting of knitted textile fabrics is concerned, terms such as "straight" or "aligned" stitch rows are wishful euphemisms.

A loop of yarn in a knitted fabric actually exhibits behavior characteristics quite different from those that logically might be expected from an ideal image of stitch rows. Behavioral characteristics of actual knitted structures were examined as they underwent compaction, so as to deal with them on their own terms with the loops and stitch rows as they actually exist in the real world.

The knitted textile fabrics when composed of natural fibers typically are manufactured in the form of continuous tubes that are then flattened and compacted in a longitudinal direction analogous to compacting of woven textile fabrics. Alternately, the knitted tubes may be split open, spread, and subjected to longitudinal compacting as open webs. Knitted textile fabrics, with small loops, or fine yarns making up the loops, require compaction as open webs. As has been noted, technology that evolved from compacting of woven textile fabric webs generally has achieved inconsistent success in treating knitted textile fabrics. Lack of consistent success has been common to compaction of knitted textile fabrics, both as tubes and as open webs. Accordingly, some people look upon compressive shrinking of knitted fabrics as an occult art.

In actual knitted textile fabrics, one frequently can expect unreliable orientation (skewing) of stitch rows formed of interlocked yarn loops. An alignment of the loops has been recognized to occur orthogonally, each individual loop relative to its related skewed stitch row.

Effective compressive shrink-proofing of knitted textile fabrics of natural fibers depends in part on expansion of heated and/or moistened yarn caused by partial unraveling of their fibers. Another reality of compaction is that the fabric reduces in volume by mechanical pushing of the interlocked loops of yarn preferably toward each other.

The loops interlock generally at right angles (orthogonally), each relative to its related stitch row. With the stitch rows unreliably organized, and the yarn loops arranged orthogonally thereto, application of longitudinal compaction through a crimped, bent, kinked, or otherwise obstructed compression zone was effective along a series of longitudinal vectors from a continuum of points along a curvilinear loop of yarn.

Simultaneously, a series of companion transverse vectors of any, or all, of the same points could thereby be either wasted or they could contribute to counterproductive stretching. Thus, a substantial portion of longitudinal compacting effort on knitted textile fabrics was self-defeating when performed through the crimped, bent, kinked, or otherwise obstructed compression zones.

Numerous innovations for fabric manipulating devices have been provided in the prior art, which will be described below in chronological order to show advancement in the art, and which are incorporated herein by reference thereto. Even though these innovations may be suitable for the individual purposes which they address, nevertheless, they differ from the present invention in that they do not teach a spring steel slip sheet for a compactor and for extending into a compression zone defined by a feed roll and a retard roll for shrinking a fabric.

(1) U.S. Pat. No. 5,553,365 to Catallo.

U.S. Pat. No. 5,553,365 issued to Catallo on Sep. 10, 1996 in class 26 and subclass 18.6 teaches an apparatus for the compressive shrinking of fibrous web materials. The apparatus uses a system of moving rolls of different speeds cooperating with a confining member to form a stuffing chamber wherein a web material moves in a passageway where it is compacted. The addition of apparatus for moving the rolls to provide a substantially uniform dimension to the passageway facilitates the compaction of the web material.

(2) U.S. Pat. No. 5,655,275 to Allison et al.

U.S. Pat. No. 5,655,275 issued to Allison et al. on Aug. 12, 1997 in class 26 and subclass 18.6 teaches a mechanical compressive shrinkage machine, especially for tubular and open width knitted fabrics, and of the type including feeding and retarding rollers cooperating with entry side and exit blades forming a compressive shrinkage zone between the rollers is provided with adjusting mechanisms. For each of the blades, there is a separate adjusting mechanism. Each includes, at each side of the machine, an in-line fluid cylinder, a technician-accessible independent adjustment, and a rotatable eccentric. The rotatable eccentrics on each side are carried by a common shaft accessible externally and providing an operator-controlled adjustment. After initial setup of the machine by a skilled technician, adjustment of the machine by the production operator is effected by rotation of a control shaft, which effects simultaneous movement of the control linkage at opposite sides of the machine. The limits of production operator control, even with full rotation of the control shaft, are such by design of the eccentric portions of the shaft as to be within a safe range to avoid damage or destruction of delicate critical parts of the equipment through careless operator action. The in-line fluid actuators, incorporated into the adjustment linkage, enable rapid, gross movement of the elements for the purpose of reconfiguring the machine in a wide open condition for clean-out. This reconfiguration is carried out by a predetermined sequence to avoid damage to the components.

(3) U.S. Pat. No. 5,666,704 to Price et al.

U.S. Pat. No. 5,666,704 issued to Price et al. on Sep. 16, 1997 in class 26 and subclass 74 teaches an upper level de-twisting mechanism provided to facilitate the handling of rope-form fabric as it is drawn from a bulk container, typically in a wet condition, and conveyed to a processing operation, such as spreading. The mechanism includes a rigid support positioned under a lifting roller and mounting a pot-eye through which the fabric is drawn. Three or more grooved guide rollers engage the lower flange of the pot-eye, supporting it for rotation about its axis. A reversible drive motor is mounted along side the pot-eye, and drive belts are trained about the drive motor output and the grooved external contours of the pot-eye for controllably rotating the pot-eye. Resiliently biased arms, each carrying a fabric engaging roller, are mounted on the top flange of the pot-eye, so that rope-form fabric passing through the pot-eye is grippingly engaged between the rollers for positive twist control over the fabric when the pot-eye is rotated in response to a twist-sensing device arranged to sense the condition of the fabric as it is conveyed from the container.

(4) U.S. Pat. No. 5,669,155 to Hughes et al.

U.S. Pat. No. 5,669,155 issued to Hughes et al. on Sep. 23, 1997 in class 34 and subclass 115 teaches a suction drum dryer for knitted fabrics and the like, and is provided with an adjustable width bellows mechanism for masking side margins of the drums not occupied by the fabric web. Ambient air drawn into the suction drums is thus caused to flow substantially exclusively through the material to be processed.

(5) U.S. Pat. No. 5,724,689 to Milligan et al.

U.S. Pat. No. 5,724,689 issued to Milligan et al. on Mar. 10, 1998 in class 8 and subclass 149.3 teaches a method and apparatus for finish processing of knitted fabric. Fabric supplied in a substantially dry condition and in a generally flat form is directed through an open bottom, vertically oriented steam chamber constantly supplied with fully saturated steam at atmospheric pressure. Upon exiting the steam chamber, the knitted fabric is laterally distended to a predetermined width and then subjected to finish processing, such as calendering or compacting. A sensing device in the steam chamber maintains a steam-air interface slightly above the open bottom of the chamber. More effective moisturizing of the fabric is accomplished, which enables the steaming operation to be performed prior to the spreading operation without compromising the finish processing operations.

(6) U.S. Pat. No. 5,794,317 to Allison.

U.S. Pat. No. 5,794,317 issued to Allison on Aug. 18, 1998 in class 26 and subclass 80 teaches a spreader-propeller apparatus for processing of tubular knitted fabric. Each of two spaced-apart frame sections is formed of upper and lower sheet metal sections mounting a plurality of grooved guide rollers carrying fabric-engaging propeller belts. The frame structure supports entry-side and exit-side belts, which in the mid-regions of the frame structure, are trained about vertically extended substantially cylindrical driving rolls. Smooth surfaced, large diameter tubular structural elements are rigidly secured above and below the sheet metal frame sections and are transitionally contoured in bridging portions to extend at least slightly above and slightly below the vertically extending drive rollers. The geometry of the sheet metal frame sections and the smooth wall tubing secured thereto is such that tubular knitted fabric being processed on the spreader is at all times guided away from, and held in spaced relation to, fixed surfaces presenting an edge or corner. At the discharge end of the spreader, the fabric passes over tapered guide rollers avoiding contact of the fabric with a stationary edge as the fabric exits from the spreader.

(7) U.S. Pat. No. 6,047,483 to Allison et al.

U.S. Pat. No. 6,047,483 issued to Allison et al. on Apr. 11, 2000 in class 34 and subclass 128 teaches a heating system for a mechanical compressive shrinkage apparatus in which a continuously flowing liquid heat exchange medium is caused to flow in series through each of the components required to be heated. Heat is inputted to the flowing medium in accordance with the temperature of one of the components to be heated, preferably the first in the series. Uniformity and constancy of both absolute and relative temperatures of the series-connected components is achieved. A mixture of water and propylene glycol alcohol is a heat exchange medium for the purpose, which allows operation at lower pressure without the maintenance problems of a system using, for example, oil as the exchange medium.

(8) U.S. Pat. No. 6,681,461 to Catallo.

U.S. Pat. No. 6,681,461 issued to Catallo on Jan. 27, 2004 in class 26 and subclass 18.6 teaches a method and related apparatus for shrink-proofing a fabric, typically a knitted textile composed of interlocked loops of yarn made of natural and/or man-made fibers. The loops interlock along stitch rows that may become skewed. The fabric is confined from expanding as it is delivered to, and discharged from, an in-line compression zone free of obstructions, such as crimps, bends, or kinks. The fabric is confined, preferably resiliently, coming to, passing through, and leaving the compression zone so as to accommodate variation of thickness and irregularities of the fabric being compacted in the compression zone. The interlocked loops are organized, whereby they are allowed to move toward each other orthogonally along their related stitch row so as to reduce volume of the fabric. Non-woven textiles, papers, papers with additives, and the like are shrink-proofed in a same manner.

(9) NAVIS TubeTex.

NAVIS TubeTex at http://www.navisglobal.com/tubetex_paknit50.html teaches a fabric compactor including a shoe quadrant adjustment, a hot oil heating system, a fabric spreader, a compaction station, an operator panel, a fabric hole detector, a pneumatic edge drive positioner, an AC inverter control with PLC, a yardage/meter counter, and an intensive steam box system. The shoe quadrant adjustment allows an operator to make quick and precise changes in fabric styles without changing machine settings. The numbered quadrants give exact setting standards for each maximum settings for shoe tips, and has a separate quick cleaning feature of the compaction station to prevent mis-adjustment. The fabric width spreader spreads fabrics to a desired finished width. The fabric is spread by an internal belt driven expander. A gas-charged expander allows width adjustments to over 12 inches with the machine in operation. The compaction station includes two rolls and two heated shoes. The shoes' function is to present the fabric into the compaction zone. The feed roll overfeeds fabric into the compaction zone while the slower retard roll holds the fabric in the zone. If more shrinkage is required, then the retard roll speed is decreased. This decease in retard roll speed will increase the compaction and reduce length shrinkage. The operator panel is a touchscreen controlling multiple machine functions.

It is apparent that numerous innovations for fabric manipulating devices have been provided in the prior art that are adapted to be used. Furthermore, even though these innovations may be suitable for the specific purposes to which they address, nevertheless, they would not be suitable for the purposes of the embodiments of the present invention as heretofore described, namely, a spring steel slip sheet for a compactor and for extending into a compression zone defined by a feed roll and a retard roll for shrinking a fabric.

3. SUMMARY OF THE INVENTION

Thus, an object of the embodiments of the present invention is to provide a spring steel slip sheet for a compactor and for extending into a compression zone defined by a feed roll and a retard roll for shrinking a fabric, which avoids the disadvantages of the prior art.

Briefly stated, another object of the embodiments of the present invention is to provide a spring steel slip sheet for a compactor and for extending into a compression zone defined by a feed roll and a retard roll for shrinking a fabric. The slip sheet is for the compactor, extends into the compression zone defined by the feed roll and the retard roll for shrinking the fabric, and is made of spring steel. The slip sheet is sheet-like and includes a mounting portion and a compressing portion. The compressing portion extends from the mounting portion at an interface line. The mounting portion usually is flat and the compressing portion usually is arcuate. The compressing portion curves similarly as the feed roll of the compactor does, and presses the fabric against the feed roll of the compactor as the fabric enters the compression zone of the compactor.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawings.

4. BRIEF DESCRIPTION OF THE DRAWINGS

Figure 2:
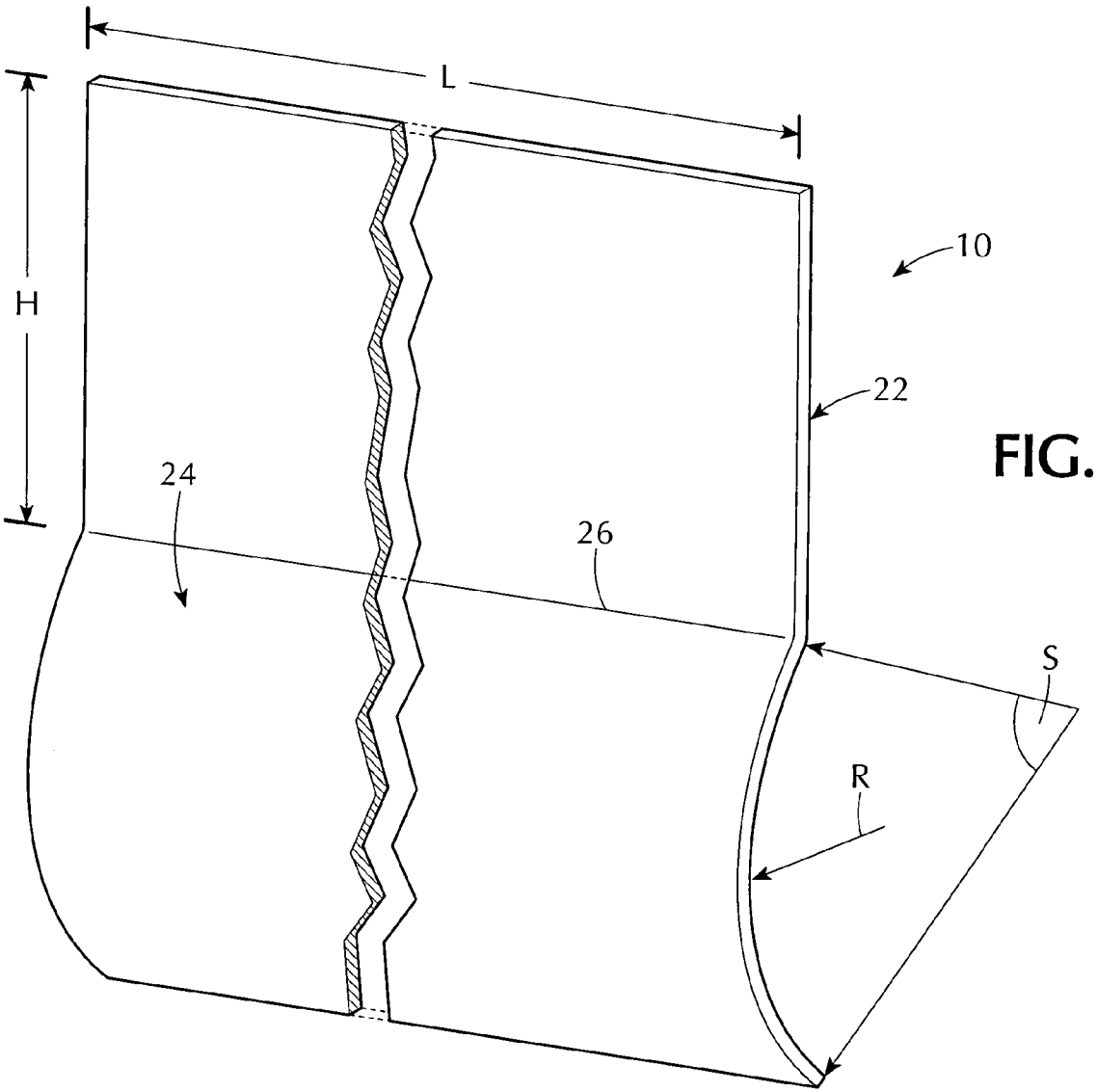

The figures of the drawings are briefly described as follows:

FIG. 1 is a partially exaggerated diagrammatic side view of the spring steel slip sheet of the embodiments of the present invention of a compactor and extending into a compression zone defined by a feed roll and a retard roll for shrinking a fabric; and FIG. 2 is a diagrammatic perspective view of the spring steel slip sheet of the embodiments of the present invention identified by ARROW 2 in FIG. 1.

5. LIST OF REFERENCE NUMERALS UTILIZED IN THE DRAWINGS

A. General

10 spring steel slip sheet of embodiments of present invention for compactor 12 and for extending into compression zone 14 defined by feed roll 16 and retard roll 18 for shrinking fabric 20
12 compactor
14 compression zone
16 feed roll
18 retard roll
20 fabric

B. Specific Configuration of Spring Steel Slip Sheet 10

H height of mounting portion 22
L length of spring steel slip sheet 10
R radius of curvature of compressing portion 24
S sweep of compressing portion 24
22 mounting portion
24 compressing portion
26 interface line

6. DETAILED DESCRIPTION OF THE PREFERRED EMBODIMENTS

A. General

Referring now to the figures, in which like numerals indicate like parts, and particularly to FIG. 1, which is a partially exaggerated diagrammatic side view of the spring steel slip sheet of the embodiments of the present invention of a compactor and extending into a compression zone defined by a feed roll and a retard roll for shrinking a fabric, the spring steel slip sheet of the embodiments of the present invention is shown generally at 10 for a compactor 12 and for extending into a compression zone 14 defined by a feed roll 16 and a retard roll 18 for shrinking a fabric 20.

B. Spring Steel

The spring steel slip sheet 10 is made of spring steel from 0.010" blue tempered shim stock.

(1) Definition of Spring Steel.

Spring steel is a low alloy, medium carbon steel with a very high yield strength. This allows objects made of spring steel to return to their original shape despite significant bending or twisting. Spring steel also exhibits resistance to high stresses and good fatigue properties.

Silicon is the key component to most spring steel alloys. Spring steel contains 1.50%-1.80% silicon, 0.70%-1.00% manganese, and 0.52%-0.60% carbon. Most spring steels are hardened and then tempered to about 45 on the Rockwell C-Scale.

(2) Physical Properties of Spring Steel.

Density=0.284 lb/in.

(3) Mechanical Properties of Spring Steel.

Hardness, Rockwell C=41.0-60.0.

Tensile Strength, Yield=231000-399000 psi.

Modulus of Elasticity=30500 ksi.

Poissons Ratio=0.313.

Shear Modulus=11600 ksi.

(4) Thermal Properties of Spring Steel.

Maximum Service Temperature, Air=248° F.

(5) Material Component Properties of Spring Steel.

Carbon, C=0.700-1.00%.

Iron, Fe ≧98.4%.

Manganese, Mn=0.200-0.600%.

(6) Advantages of Spring Steel.

Good formability.

Hard.

Resists high stress and/or infrequent stress.

Resists damage caused by repetitive motion.

Maintains straightness.

Good thermal properties.

High endurance properties at elevated temperatures.

High fatigue properties at elevated temperatures.

(7) Blue Tempered Spring Steel.

Pretempered spring steel can withstand mild forming, but when the finished piece is a blanked part, it is usually the only economical raw material to consider. Blue tempered spring steel's uses include doctor blades, all types of flat springs, motor springs, steel tapes, valves, reeds, and numerous other applications.

(8) Hardening.

Hardening by heat treatment is a method used to alter the physical, and sometimes chemical, properties of a material. The most common application is metallurgical. Heat treatment involves the use of heating or chilling, normally to extreme temperatures, to achieve a desired result, such as hardening or softening of a material. Heat treatment techniques include annealing, case hardening, precipitation strengthening, tempering, and quenching. It is noteworthy that while the term heat treatment applies only to processes where the heating and cooling are done for the specific purpose of altering properties intentionally, heating and cooling often occur as incidental phases of other manufacturing processes, such as hot forming or welding.

(9) Heat Treatment.

Metallic materials consist of a microstructure of small crystals called "grains" or crystallites. The nature of the grains, i.e., grain size and composition, determine the overall mechanical behavior of the metal. Heat treatment provides an efficient way to manipulate the properties of the metal by controlling rate of diffusion and the rate of cooling within the microstructure.

(10) Annealing.

Annealing is a technique used to recover cold work and relax stresses within a metal. Annealing typically results in a soft, ductile metal. When an annealed part is allowed to cool in the furnace, it is called a "full anneal" heat treatment. When an annealed part is removed from the furnace and allowed to cool in air, it is called a "normalizing" heat treatment. During annealing, small grains recrystallize to form larger grains. In precipitation hardening alloys, precipitates dissolve into the matrix "solutionizing" the alloy.

(11) Hardening and Tempering (Quenching and Tempering).

To harden by quenching, a metal, usually steel or cast iron, must be heated into the austenitic crystal phase and then quickly cooled. Depending on the alloy and other considerations, such as concern for maximum hardness vs. cracking and distortion, cooling may be done with forced air or other gas, such as, nitrogen, oil, and a polymer dissolved in water or brine. Upon being rapidly cooled, the austenite transforms to martensite, a hard brittle crystalline structure.

Untempered martensite, while very hard and strong, is too brittle to be useful for most applications. A method for alleviating this problem is called tempering. Most applications require that quenched parts be tempered, i.e., heat treated at a low temperature, often 300° F. or 150° C. to impart some toughness. Higher tempering temperatures may be up to 1300° F. depending on alloy and application are sometimes used to impart further ductility, although some strength is lost.

Complex heat treating schedules are often devised by metallurgists to optimize an alloy's mechanical properties. In the aerospace industry, a super alloy may undergo five or more different heat treating operations to develop the desired properties. This can lead to quality problems depending on the accuracy of the furnace's temperature controls and timer.

(12) Precipitation Hardening.

Some metals are considered precipitation hardening metals. Examples include 2000 series, 6000 series, and 7000 series aluminum alloy, as well as some super alloys and some stainless steels. If a precipitation hardened alloy is quenched, its alloying elements will be trapped in solution, resulting in a soft metal. Aging a "solutionized" metal, either at room temperature—"natural aging"—or at a few hundred degrees—"artificial aging", allows the alloying elements to diffuse through the microstructure and form intermetallic particles. These intermetallic particles fall out of solution and act as a reinforcing phase, thereby increasing the strength of the alloy. In some applications, naturally aging alloys may be stored in a freezer to prevent hardening until after further operations. Assembly of rivets, for example, may be easier with a softer part.

(13) Selective Hardening.

Some techniques allow different areas of a single object to receive different heat treatments. This is called differential hardening.

C. The Specific Configuration of the Spring Steel Slip Sheet 10

The specific configuration of the spring steel slip sheet 10 can best be seen in FIG. 2, which is a diagrammatic perspective view of the spring steel slip sheet of the embodiments of the present invention identified by ARROW 2 in FIG. 1, and as such, will be discussed with reference thereto.

The spring steel slip sheet 10 is sheet-like, and comprises a mounting portion 22 and a compressing portion 24. The compressing portion 24 extends from the mounting portion 22 at an interface line 26.

The mounting portion 22 is flat and the compressing portion 24 is arcuate.

The mounting portion 22 has a height H of 2.75".

The compressing portion 24 curves similarly as the feed roll 16 of the compactor 12 does, and presses the fabric 20 against the feed roll 16 of the compactor 12 as the fabric 20 enters the compression zone 14 of the compactor 12.

The compressing portion 24 has a radius of curvature R of 2.75" and traverses a sweep S of ≈76°.

The spring steel slip sheet 10 has a length L of 79" when used with an 80" compactor 12, 89" when used with a 90" compactor 12, and 99" when used with a 100" compactor 12.

D. The Alternate Materials of the Slip Sheet

The slip sheet can also be made of a hard and highly resilient material selected from the group consisting of acryllnitrile butadiene styrene, aluminum, aramid, carbon fiber reinforced plastic, fiberglass, graphite, polyvinyl chloride, spring steel, spring steel alloyed with manganese, nickel, chromium, and combinations thereof.

E. Impressions

It will be understood that each of the elements described above or two or more together may also find a useful application in other types of constructions differing from the types described above.

While the embodiments of the present invention have been illustrated and described as embodied in a spring steel slip sheet for a compactor and for extending into a compression zone defined by a feed roll and a retard roll for shrinking a fabric, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A device for shrinking a fabric, comprising:

a compactor;

wherein said compactor includes a feed roll;

wherein said compactor includes a retard roll;

wherein said compactor includes a spring steel slip sheet;

wherein said feed roll of said compactor and said retard roll of said compactor define a compression zone therebetween;

wherein said spring steel slip sheet of said compactor includes a mounting portion;

wherein said spring steel slip sheet of said compactor includes a compressing portion;

wherein said compressing portion of said spring steel slip sheet of said compactor extends from said mounting portion of said spring steel slip sheet of said compactor at an interface line; and wherein said compressing portion of said spring steel slip sheet of said compactor extends into said compression zone of said compactor and curves similarly as said feed roll of said compactor does to thereby press the fabric against said feed roll of said compactor as the fabric enters said compression zone of said compactor for shrinking the fabric.

2. The device of claim 1, wherein said spring steel slip sheet of said compactor is sheet-like.

3. The device of claim 1, wherein said mounting portion of said spring steel slip sheet of said compactor is flat.

4. The device of claim 1, wherein said compressing portion of said spring steel slip sheet of said compactor is arcuate.

5. The device of claim 1, wherein said mounting portion of said spring steel slip sheet of said compactor has a height of 2.75".

6. The device of claim 1, wherein said compressing portion of said spring steel slip sheet of said compactor has a radius of curvature of 2.75".

7. The device of claim 1, wherein said compressing portion of said spring steel slip sheet of said compactor traverses a sweep of ≈76°.

8. The device of claim 1, wherein said spring steel slip sheet of said compactor has a length of 79" for use with an 80" compactor or a length of 89" for use with a 90" compactor or a length of 99" for use with a 100" compactor.

9. The device of claim 1, wherein said spring steel slip sheet of said compactor is made of a material selected from the group consisting of acryllnitrile butadiene styrene, aluminum, aramid, carbon fiber reinforced plastic, fiberglass, graphite, polyvinyl chloride, spring steel, spring steel alloyed with manganese, nickel, chromium, and combinations thereof.

* * * * *